US005123179A

United States Patent [19]

VanDelinder

[11] Patent Number: 5,123,179

[45] Date of Patent: Jun. 23, 1992

[54] DRYER FOR POLYMER STRANDS

[75] Inventor: George S. VanDelinder, Lunenburg, Mass.

[73] Assignee: Polysar Financial Services S.A., Fribourg, Switzerland

[21] Appl. No.: 679,321

[22] Filed: Apr. 2, 1991

[51] Int. Cl.[5] ..... F26B 13/30

[52] U.S. Cl. ..... 34/92; 34/16

[58] Field of Search ..... 34/15, 16, 92

[56] References Cited

U.S. PATENT DOCUMENTS

| | | | |
|---|---|---|---|
| 2,929,154 | 3/1960 | Finnegan | 34/92 |
| 3,755,526 | 8/1973 | Watanabe | 264/178 |
| 4,088,468 | 5/1978 | Roberson | 34/92 |
| 4,231,164 | 11/1980 | Barbee | 34/92 |
| 4,570,359 | 2/1986 | Rudolph | 34/58 |
| 4,632,752 | 12/1986 | Hunke | 210/173 |

FOREIGN PATENT DOCUMENTS 0260606 3/1988 European Pat. Off. .

*Primary Examiner*—Henry A. Bennett
*Assistant Examiner*—Denise L. Gromada
*Attorney, Agent, or Firm*—Stevens, Davis, Miller & Mosher

[57] ABSTRACT

A polymer strand dryer comprising in cooperating arrangement a main vacuum line, a secondary vacuum line having therein a water separation means, and a bifurcated head with suction arms extending from each branch of the bifurcated head permits a faster rate of drying polymer than conventional dryer heads.

10 Claims, 1 Drawing Sheet

DRYER FOR POLYMER STRANDS

FIELD OF THE INVENTION

The present invention relates to suction dryers. More particularly the present invention relates to suction dryers which may be used to dry strand materials. More particularly the present inventions relates to suction dryers which may be used to dry strands of polymers as they emerge from liquid cooling baths.

BACKGROUND OF THE INVENTION

In the manufacture of polymers or polymer alloys hot extruded strands of polymer are often cooled by passing the strands of polymer through a cooling bath of a liquid, usually water. Typically the cooling bath would be in the order of tens of feet long. The cool wet strands are then drawn from the cooling tank or bath and dried. The polymer strands must be dried before being chopped to pellets. While this sounds relatively easy it is in fact one of the rate limiting steps in the production of polymers or alloys.

In a conventional polystyrene plant the polymer strands are dried by passing the strands over a blower. In theory the blower blows off the water adhering to the surface of the polymer strand. However, at the rates required to operate a world scale plant the drying is often just barely adequate. If there is any difficulty with the dryer then the lines are insufficient. In many instances backup motors are kept available should there be a problem. Generally there seem to be two schools of thought on this arrangement. One school of thought favours a centralized blower with a ducting system through the plant to each of the dryers. This type of system permits the use of high horsepower blowers and some efficiency of scale but is burdened with the cost of a high horse power blower to be held in back up. The other school of thought favours individual blowers for each drying station. Lower powered blowers are required in such a case and there is a lower potential for a total failure of the system. However, such systems may be more inefficient in terms of overall energy consumption per unit of polymer dried.

Generally the type of dryers used in association with drying thermoplastic strands which have been cooled in a water bath are shown schematically in the drawing of U.S. Pat. No. 3,755,526 issued Aug. 28, 1973, assigned to Mobil Oil Company. The patent is of interest in that it teaches chopping the strands to pellets prior to drying.

There have been several attempts to improve the efficiency of pellet dryers. However, these improved dryers tend to be fairly complicated mechanically.

U.S. Pat. No. 4,632,752 issued Dec. 30, 1986 in the name of Friedrich Hunke, discloses a device for cooling and drying polymer strands in which the cooling trough is downwardly sloping from the extruder to the pelletizer. The strands of polymer flow down the trough together with a stream of water. The water is withdrawn from the trough through a drain then air is drawn over the wet strands to remove any water adhering to the strands. The resulting dried strands are then pelletized. The art does not suggest the dryer construction of the present invention. However, the reference is of interest in that it proposes the use of a sucker rather than a blower.

There are several patents in the name of Werner & Pfleiderer which relate to drying pelletized polymer.

These are represented by European patent 260 606 dated Mar. 23, 1988 and U.S. Pat. No. 4,570,359 issued Feb. 18, 1986. In these patents the polymer strands are pelletized under water then the pellets and water are drawn up a vertical pipe where the water is separated from the polymer. The references do not suggest the type of apparatus claimed in the present application.

The present patent application seeks to provide a simple suction dryer which may be used to dry polymer strands prior to pelletizing.

SUMMARY OF THE INVENTION

The present invention provides a suction dryer comprising in cooperating combination, a water separation means, a main vacuum line having at its exit a vacuum generating means, said main vacuum line being attached to at least one secondary vacuum line which terminates in a coupling adapted to receive a bifurcated suction head comprising a base which is received by and cooperates with said coupling to permit said base to rotate about the opening of said secondary vacuum line, a bifurcating section attached to said base and dividing said base into branches, arms having one or more openings along their surface extending from said branches, said arms being closed at their ends distant from said branches and being open at their ends proximate said branches and joined to said branches by couplings adapted to receive said arms and to permit said arms to rotate about the ends of said branches.

The present invention also provides a process of drying a polymer strand after it emerges from a liquid cooling bath which comprises passing the strand over the slots in the arms of a suction dryer as described above.

DETAILED DESCRIPTION

Figure 1:
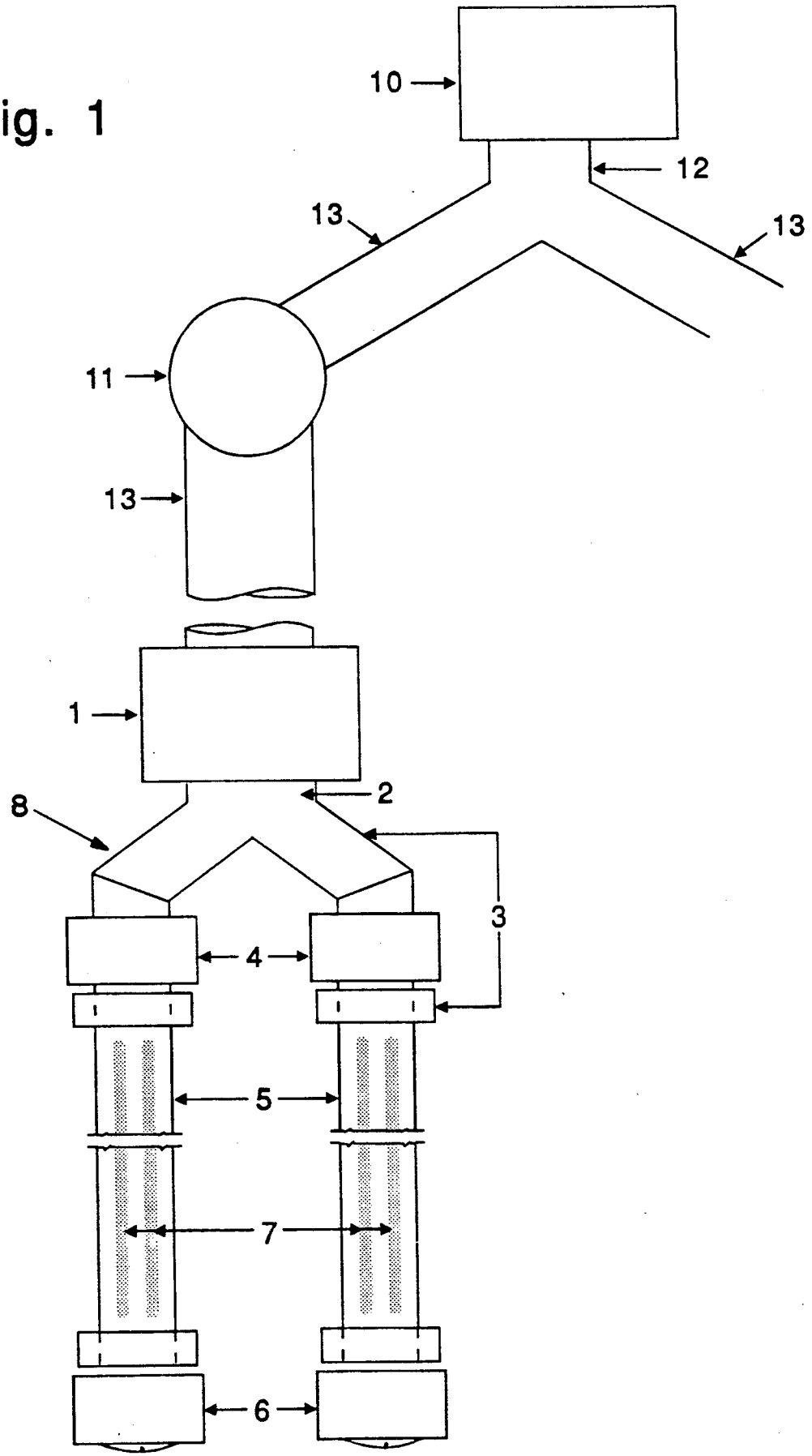

FIG. 1 is a schematic drawing of a top view of the head of a suction dryer in accordance with the present invention.

For the sake of simplicity the present invention will be described in association with a polymer. In this specification the term polymer is intended to include both polymer per se and polymer alloys.

The present invention will be described in association with FIG. 1 in which like numbers designate like parts.

The suction dryer in accordance with the present invention comprises a main vacuum line 12 having at its exit or open end a vacuum generating means 10. Typically the vacuum generating means will be an industrial type centrifugal blower capable of maintaining a vacuum of not less than about 30 inches of water. The apparatus of the present invention may be a centralized vacuum type or it may comprise individual vacuum blowers for one or two drying stations. The selection of motor for the vacuum blower and type of blower will depend on which type of system is used.

A water separation means 11 is used in combination with the suction dryer. Typically the water separation means will comprise a drum or a cyclone installed in the vacuum line to permit the separation of air and water. To permit the removal of water from the water separation means the drum or cyclone should have a water leg, preferably in association with a sealing chamber to permit removal of water from the water separation means periodically during operation. Preferably the water separation means is installed proximate the suction dryer head 8. The water separation means is installed proximate the suction dryer head 8 to minimise the distance water is drawn through the vacuum line. This will help reduce moisture problems in the vacuum line. Most preferably the water separation means is installed in the secondary vacuum line 13.

The main vacuum line 12 is attached to at least one secondary vacuum line 13 which as noted above preferably contains a water separation means.

The secondary vacuum line 13 ends in a coupling or collar 1 adapted to receive a suction head 8. The collar or coupling 1 is adapted to receive the suction head 8 and to permit it to rotate about the open end of the secondary vacuum line 13. Preferably the collar or coupling 1 will permit the suction head 8 to rotate through 360°. However, a lower degree of rotation would also be useful. Generally the suction head 8 should be able to rotate through at least 180°. The collar 1 should also provide for the quick removal and/or insertion of a new suction head 8. For example commercially available quick release coupling such as those known as ASW male adapters for pipe or tube welding or ABW male adapters for butt welding and female DSW adapters for pipe or tube welding or female DBW adapters for butt welding are useful in couplings in these applications.

Generally the collar or coupling 1 will have a gasket to maintain high vacuum across the coupling. The gasket should interact with the base 2 of the suction head 8.

The suction head 8 comprises a base 2 which is attached to a bifurcating portion 3 which separates the base into at least two portions. The bifurcating portion may be "y" shaped or "u" shaped or have another suitable shape. Due to the nature of operation of the device of the present invention as will be explained later the number of branches will be even (eg. 2). Each branch terminates with a coupling or collar 4 similar to that on the secondary vacuum line 13 which receives a suction head 8. That is the coupling or collar 4 is adapted to receive arms 5 and to permit arms 5 to rotate about the open end of the branched portion.

The arms 5 comprise a closed end. The closing may be any suitable closing embodiment such as threads on the ends of the arms and a cap 6 which screws onto the end of the arm 5. Other closing arrangements may be used such as a slip on cap 6 with a gasket or coupling with mating collar on the cap 6. If a slip on cap is used the internal diameter of the cap and the external diameter of the end of the arm are closely matched so that the cap and the end of the arm will closely or accurately fit. Such a fit is sometimes referred to as a friction fit. Such an arrangement permits the arms to be removed from the branching portions of the suction head and to be opened at each end to permit cleaning of the arms. To prevent strands or pieces thereof from entering the slots, a screen assembly is inserted in each arm or tube with the screen located under the opening in the slot in the arm. The screen mesh size is smaller than the strand diameter, yet large enough to minimize affects on vacuum.

On the surface of the arms are one or more openings 7. The openings may comprise one or more longitudinal slots or rows of perforations or some other suitable opening means. In a preferred embodiment the arms comprise a close fitting inner and outer pipe with slots there in. The pipes may be rotated relative to each other to control the size of openings in the arms. Generally, the openings will be on that portion of the arm in contact with the polymer strand. In terms of efficiency there will likely not be more than two or three parallel slots or rows of perforations.

On the arms adjacent the ends of the openings are strand guides. The strand guides keep the strands located over the openings in the arms.

In operation the polymer strands are continuously drawn from the cooling tank or bath and passover the arms of the suction head. It is important to note that the arms of the suction head may be used in several configurations. For example in FIG. 1, the arms are in an over-/over configuration. That is the polymer strand would first travel over the slots or rows of perforations in one arm then over the slots or rows of perforations in the second arm of the suction head. In such a configuration the suction arms act as supports to hold up the strands of polymer. As the suction head may be rotated the angle of the polymer strand may conform to the entrance of the pelletizer (eg. a slight upward slope). In such a configuration the arms would be individually rotated so that the slots or rows of perforations face upwards.

However, the suction head may be used in an over-/under configuration. In such a configuration the polymer strand travels over the first arm of the suction head then under the second arm of the suction head. The arms are rotated so that the first arm has slots of rows of perforations facing upwardly while the second arm has the slots or rows of perforations facing down. There are several advantages to such a configuration. The polymer strand is treated on both its upper and lower facing surfaces. Secondly, the base and arms may be rotated to maintain the polymer strand under tension to ensure close contact of the polymer strand as it passes over the slots or rows of perforations in the arms. Thirdly, such an arrangement maintains the polymer strands under a slight tension restraining their movement and insuring uniform feed to the cutter.

Generally the vacuum lines and the suction head will be made from piping. However, other shapes of ducting may also be suitable such an hexagonal or square. It is noted that configurations other than round may limit the freedom to rotate the suction head and arms. As there is a desire to obtain close contact with the strands of polymer with the longitudinal slots or rows of perforations such other shaped ducting may be less desirable.

The present invention will now be described in the following experiment which is intended to illustrate and not limit the invention.

EXAMPLE 1

In a polyslyrene plant the existing drying equipment comprised a standard suction plate or head below a series of polymer strands emerging form a cooling bath. The slot in the suction head was 0.875 inches (22 mm) wide. The maximum vacuum which could be obtained was 15-20 inches of water. The polymer strands were ⅛ of an inch (3.75 mm) in diameter. Under these conditions the maximum rate at which the polymer strands could be drawn over the drying head and achieve sufficient drying was about 150 ft/min (45 m/min).

Using an over/under configuration with head similar to that of the present invention except that the device was operated as a blower rather than a sucker the maximum rate at which polymer strands could be passed through the dryer head and still achieve adequate drying was up to 195 ft/min (58-59 m/min). However, with this system there was a problem with water accumulation in the area of the chopper. That is the water blown off the polymer strands accumulated in puddles on the floor. Such an operation would not have been safe for employees. Further this configuration caused chaotic movement of the strands which required additional equipment to be installed to insure uniform feeding of the strands into the cutters.

The device of the present invention (eg. sucker) was operated in an over under configuration. Using such a configuration in a suction mode it was possible to routinely dry polymer at rates up to 220 ft/min (67 m/min).

Additionally, there was no accumulation of water on the floor of the plant in the area of the chopper using the equipment in this manner, and the need for additional equipment prior to the cutter was eliminated.

This experiment shows that the suction dryer of the present invention permits greater through put of polymer strands in a safer manner than in accordance with the present suction devices or the device of the present invention operated as a blower.

What is claimed is:

1. The present invention provides a suction dryer comprising in cooperating combination, a water separation means, a main vacuum line having at its exit a vacuum generating means, said main vacuum line being attached to at least one secondary vacuum line which terminates in a coupling adapted to receive a bifurcated suction head comprising a base which is received by and co-operates with said coupling to permit said base to rotate about the opening cf said secondary vacuum line, a bifurcating section attached to said base and dividing said base into branches, arms having one or more openings along their surface extending from said branches, said arms being closed at their ends distant from said branches and being open at their ends proximate said branches and joined to said branches by couplings adapted to receive said arms and to permit said arms to rotate about the ends of said branches.

2. The suction dryer according to claim 1, wherein said main vacuum line and said at least one secondary vacuum line comprise pipes.

3. A suction dryer according to claim 2, wherein said water separation means is selected from the group consisting of a drum and a cyclone.

4. A suction dryer according to claim 3, wherein said water separation means is in.,said at least one secondary vacuum line.

5. A suction dryer according to claim 4, wherein said couplings comprises a releasable sleeve and contains a gasket to reduce vacuum loss across the coupling.

6. A suction dryer according to claim 5, wherein said branching portion divides said base into two arms.

7. A suction dryer according to claim 6, wherein said arms are closed by a cap.

8. A suction dryer according to claim 5, wherein the internal diameter of said cap and the external diameter of the end of said arm are matched so that said cap fits friction fits on said end of said arm.

9. A suction dryer according to claim 8, wherein said arms have at least one longitudinal slot on their surface.

10. A suction dryer according to claim 9, wherein said arms comprise slotted pairs of pipes one fitting within the other to permit the pipes to be rotated relative to each other to adjust the width of the slots at the surface of the arms.

* * * * *